US006094488A

United States Patent [19]

Bianchessi et al.

[11] Patent Number: 6,094,488

[45] Date of Patent: Jul. 25, 2000

[54] DYNAMIC COMPUTATION OF THE RATIO BETWEEN TWO BITSTREAMS REPRESENTING SLOWLY VARYING QUANTITIES AND DOLBY PRO LOGIC DECODER

[75] Inventors: Marco Bianchessi, Sergnano; Sandro Dalle Feste, Novara; Nadia Serina, Castelcovati; Davide Sanguinetti, Sestri Levante, all of Italy

[73] Assignee: SGS-Thomson Microelectronics S.r.l., Agrate Brianza, Italy

[21] Appl. No.: 08/970,845

[22] Filed: Nov. 14, 1997

[30] Foreign Application Priority Data

Nov. 20, 1996 [IT] Italy ..... VA96A0026

[51] Int. Cl.[7] ..... H04R 5/00

[52] U.S. Cl. ..... 381/22; 381/27

[58] Field of Search ..... 381/22, 18, 20, 381/77, 80, 27

[56] References Cited

U.S. PATENT DOCUMENTS 5,774,512 6/1998 Bhatt et al. ..... 375/376

*Primary Examiner*—Forester W. Isen
*Assistant Examiner*—Brian Tyrone Pendleton
*Attorney, Agent, or Firm*—Theodore E. Galanthay; Allen, Dyer, Doppelt, Milbrath & Gilchrist, P.A.

[57] ABSTRACT

The ratio y(n) of two digital values, respectively a(n) and b(n), representing the $n^{th}$ elements of two respective sequences of digital input data representing two quantities slowly varying in time, is obtained by computing $$y(n)=y(n-1)+g*[a(n)-b(n)*y(n-1)]$$

wherein g represents a multiplying factor. Within the domain of the z transform, the expression becomes:

$$Y(z)=z^{-1}*Y(z)+g[A(z)-B(z)\text{conv } Y(z)*z^{-1}$$

where conv indicates an operation of convolution and which, for input sequences corresponding to signals filtered through a lowpass filter with a time constant greater than or equal to 3 msec is simplified to:

$$Y(z)=\frac{g*A(z)}{1-z^{-1}+g*B(z)*z^{-1}}=\frac{A}{B}$$

The approximation is exceptionally good and computation thereof may be achieved by the use of relatively simple hardware, without severely burdening the workload of a microprocessor.

7 Claims, 5 Drawing Sheets

DYNAMIC COMPUTATION OF THE RATIO BETWEEN TWO BITSTREAMS REPRESENTING SLOWLY VARYING QUANTITIES AND DOLBY PRO LOGIC DECODER

FIELD OF THE INVENTION

The present invention relates to processing circuits of digital signals, and, more particularly, for dynamic processing of the ratio of two slowly varying digital signals. The invention is particularly useful in Dolby Pro Logic decoders (© 1995 Dolby Labs, U.S.A.) for digital audio apparatus.

BACKGROUND OF THE INVENTION

In digital systems for recording and playing back audio signals, with or without broadcast and reception steps, coding/decoding devices are useful and widely used to reduce memory or bandwidth requirements. Such devices generally extract from one or more digital input signals, a set of decoded signals (channels), by performing an appropriate decoding algorithm.

For example, the well known Dolby Pro Logic system permits the extraction of four to six decoded channels from two codified digital input signals. The decoding algorithm is based on a processing that derives from the particular coding system used and may be generically illustrated by way of a diagram as shown in FIG. 1. Based on two sequences or digital input streams, referred to as Left_total and Right_total, respectively, four fundamental output channels are extracted, indicated as Left, Right, Central and Surround, respectively.

A Dolby Pro Logic decoding system may be exemplified as shown in FIG. 2. The input signals Left_total and Right_total are, as mentioned, digital audio signals and thereby have a peculiar band of frequencies that vary from 0 to 20 KHz and a sampling frequency that may be of 32, 44.1 or 48 KHz, according to most common system embodiments.

The block CONTROL of FIG. 2 represents the processing circuitry to which the present invention relates. A typical processing circuit, represented by the block CONTROL in the scheme of FIG. 2, is shown by way of a functional diagram in FIG. 3, using a common Simulink symbology in a Matlab environment.

By observing the functional scheme of FIG. 3, the first processing on the two input signals is a bandpass filtering with a passband from 200 Hz to 5 KHz. After the filtering, from the two resulting signals, the sum (corresponding to the Central channel) and the difference (corresponding to the Surround channel) are calculated, and thereafter the absolute value of the four signals thus obtained is determined. The following stage is a lowpass filtering stage, typically with a time constant of 3 msec, equivalent to a cut-off frequency of about 50 Hz.

The value of the time constant and therefore of the cut-off frequency is preferably normalized to the Nyquist frequency which represents the effective signal band in sampled systems. The Nyquist frequency is equal to a half of the implemented sampling frequency. For the example considered, the sampling frequency is 5.125 KHz and therefore the Nyquist frequency is 5.125/2≅2.7 KHz. Since a time constant of 3 msec corresponds to a cut-off frequency of ½Π3=53 Hz, the portion of the bands that are not attenuated by the lowpass filter is about 53/2700, that is approximately 2% of the whole signal spectrum.

At this stage of the processing, the high frequency components contained in the codified input signals have been attenuated and the resulting signals are varying slowly and have a trend that coincides approximately to the envelop of the input signals. Such sequences are thereafter undersampled, for example by a factor of 8, and a computing phase begins that has the purpose of determining the two output values, VLR and VCS, which indicate the ratio between the middle levels of the Left and Right, respectively, and those of the Central and Surround channels.

The computational algorithm of such parameters is as follows:

If LT>RT then VLR=1−(RT/LT)

If RT>LT then VLR=(LT/RT)−1

If CT>St then VCS=1−(ST/CT)

If ST>CT then VCS=(CT/ST)−1

The values of VLR and VCS vary between −1 and 1 and have the following meaning:

If VLR>0 THEN Left>Right

If VLR<0 THEN Right>Left

If VCS>0 THEN Central>Surround

If VCS<0 THEN Surround>Central

This algorithm, in itself simple, may not be so when considering a hardware implementation thereof. In fact, it entails the computation of a ratio, therefore the execution of a binary division which is a burdensome operation in terms of hardware requirements and of the clock pulses required for its execution.

In case of implementing the algorithm with a general purpose DSP (Digital Signal Processor), such as for example Motorola's 56000 family, the problem is resolved by resorting to the following equation:

$$\log(a/b)=\log a-\log b$$

whereby the logarithm of the ratio between two numbers is equal to the difference of the respective logarithms. The result of the difference is converted back to the value of the argument a/b by way of the (exponential function:

$$\exp(\log(a/b))=a/b$$

Such a hardware implementation is feasible by the use of general purpose machines provided with installed logarithmic tables. This type of solution requires however many resources, chiefly in terms of the machine time required for computing the exponential function. When considering a hardware embodiment of such an algorithm, as is often the case in an audio playback/receiver, it becomes evident that this type of approach is rather expensive because of the memory requirement for storing the look-up table of the logarithmic function.

SUMMARY OF THE INVENTION

The purpose of the present invention is to provide a simplified method of dynamic processing of the ratio between two digital values, representing the $n^{th}$ elements of two digital sequences of quantities subject to relatively slow variations in time, that can be implemented with a relatively simple and inexpensive hardware.

The present invention is useful in a broad spectrum of applications. More particularly, the present invention is useful for realizing relatively inexpensive digital audio systems.

Conceptually, the inventive is based on the realization of an automatic system capable of dynamically locking onto a value that corresponds to the ratio between the current digital values (n th) of two sequences or digital input signals (or bitstreams).

According to a first aspect of the invention, the system is capable of ensuring an effective dynamic locking onto of the ratio between two digital input values belonging to two streams or sequences of digital data and comprises:

- a differentiator having first inputs through which a first sequence of digital input data (a(n)) is applied, second inputs and corresponding outputs of a sequence of digital values corresponding to the difference between two digital input values;
- a multiplier by a constant having inputs coupled to the outputs of the differentiator and corresponding outputs;
- an adder having first inputs coupled to the outputs of the multiplier by a constant, second inputs and corresponding outputs onto which is produced the (y(n)) digital ratio value;
- a first array of bistable, one clock cycle delay circuits having inputs coupled to the outputs of the adder and as many outputs coupled to second inputs of the same adder;
- a second array of bistable, one clock cycle delay circuits having inputs coupled to the outputs of the adder and as many outputs;
- a multiplier circuit having first inputs coupled to the outputs of the second array of bistable circuits and second inputs through which is fed the other sequence of input digital data (b(n)) and as many outputs coupled to second inputs of the differentiator.

By calling a(n) and b(n) the $n^{th}$ elements of the two sequences fed to the respective inputs and y(n) the respective output element, the relationship that links them together is easily deducible from the above described architecture as:

$$y(n)=y(n-1)+g*[a(n)-b(n)*y(n-1)]$$

which in the domain of the z transform becomes:

$$Y(z)=z^{-1}*Y(z)+g*8\,A(z)-B(z)\text{conv}\ Y(z)*z^{-1}]$$

where conv denotes an operation of convolution.

In the case of slowly varying input sequences as for the case in consideration (as are the sequences downstream of a lowpass filter with a time constant of about 3 msec), that is, digital signals without high frequency components, wherein the variable z assumes modulus values close to 1, the preceding formula may be simplified to:

$$Y(z)=\frac{g*A(z)}{1-z^{-1}+g*B(z)*z^{-1}}=\frac{A}{B}$$

The constant multiplication factor g is representative of the speed of the locking of the system, as well as of its intrinsic stability, because by changing g the pole value of the system is shifted. Its value must be constantly less than unity and the closer it gets to unity the faster is the locking to the input ratio, but at the same time the system may develop stability problems.

BRIEF DESCRIPTION OF THE DRAWINGS

The different aspects of the invention as well as the outstanding simplicity of its implementation will become more evident through the following description of some important embodiments and by referring to the attached drawings, wherein.

DETAILED DESCRIPTION OF THE PREFERRED EMBODIMENTS

Figure 1:
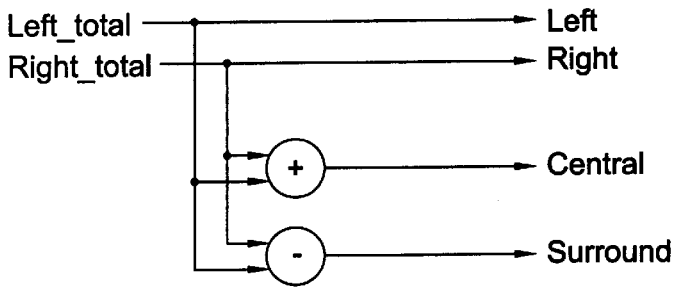
FIG. 1. (PRIOR ART)
FIG. 1 is a generic decoding scheme as in the prior art and as already described above.
Figure 2:
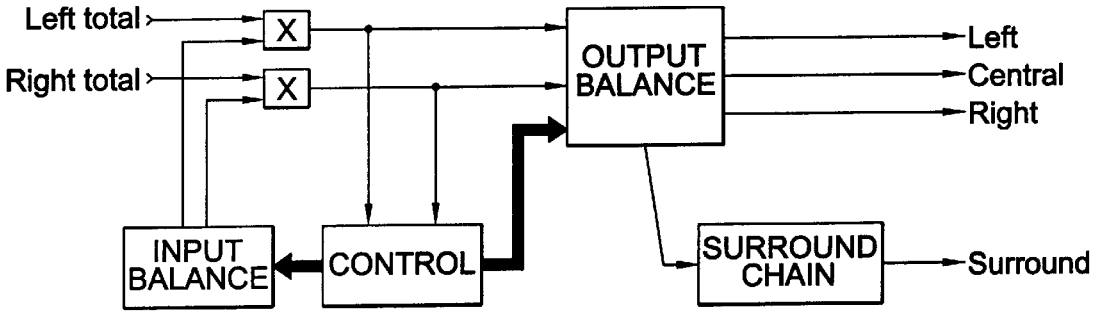
FIG. 2. (PRIOR ART)
FIG. 2 shows a Dolby Pro Logic decoding scheme for digital audio systems as in the prior art.
Figure 3:
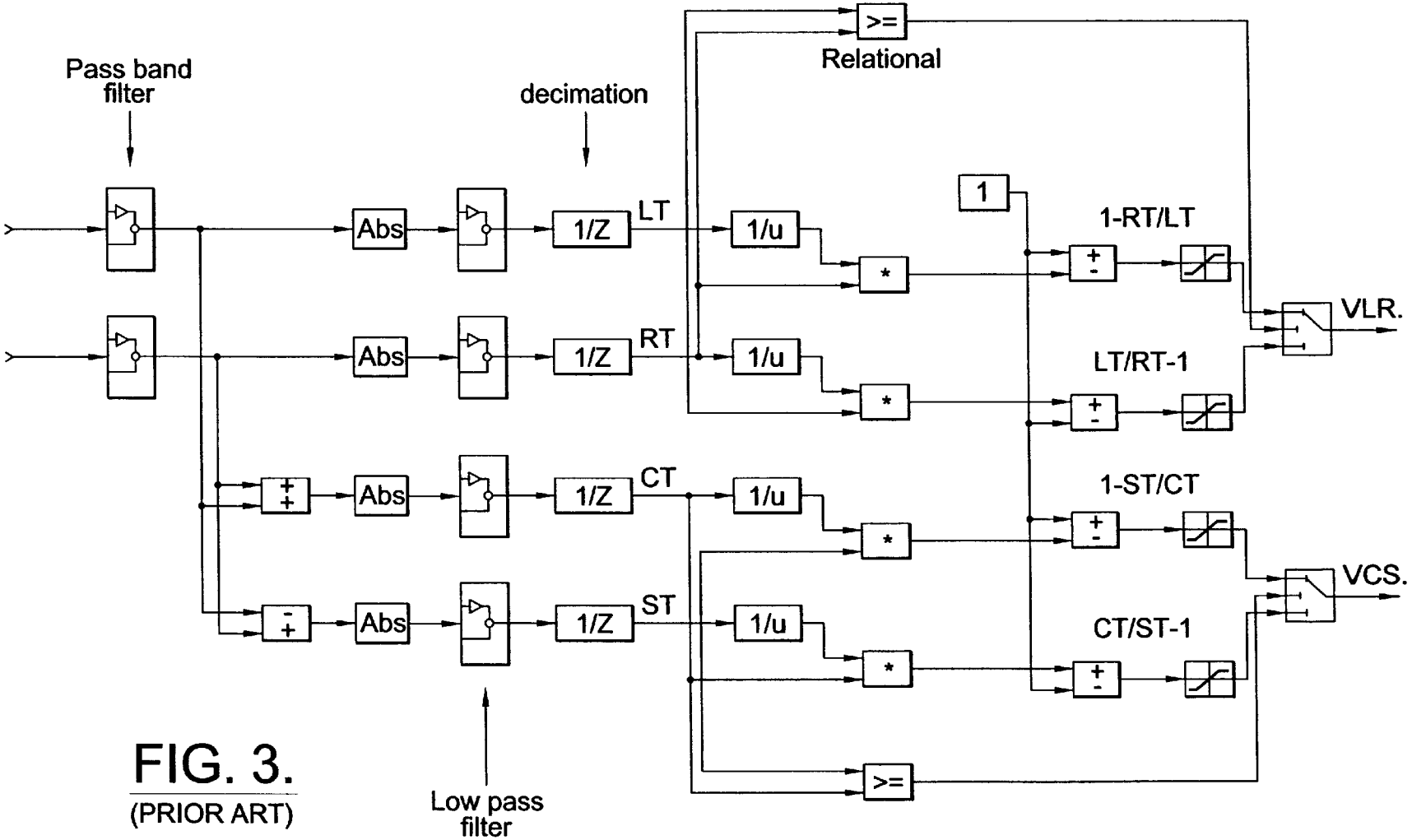
FIG. 3. (PRIOR ART)
FIG. 3 is a functional diagram of the process control block of the system of FIG. 2, as in the prior art and as already described above.
Figure 4:
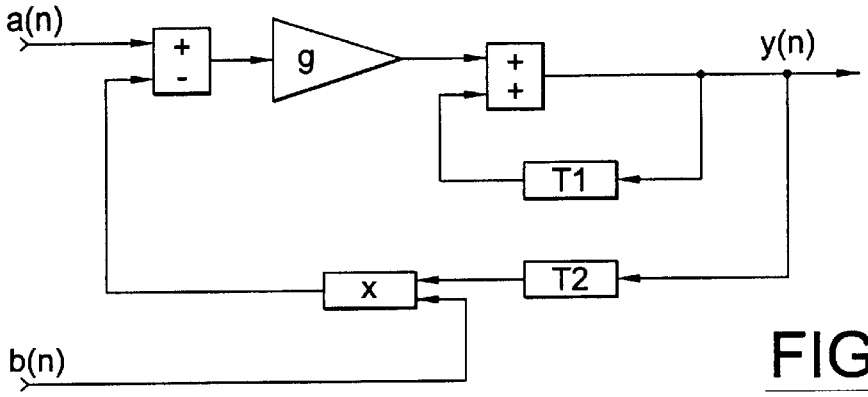
FIG. 4 is a functional diagram of an embodiment of the processing system of the present invention.

A functional scheme of implementation of the algorithm of calculation of the ratio between the current $n^{th}$ elements of two distinct input sequences corresponding to quantities that vary slowly in time is shown in FIG. 4. As previously remarked the constant g must be less than 1. In an application for an audio decoding system, the parameter g may have a value of about 0.1, for example 0.125 (⅛). In this way, the stability of the system is ensured and the locking time is of about 8 sampling instants (8 clock pulses), which in an audio system may take place with a frequency of about 5 KHz.

Figure 5:
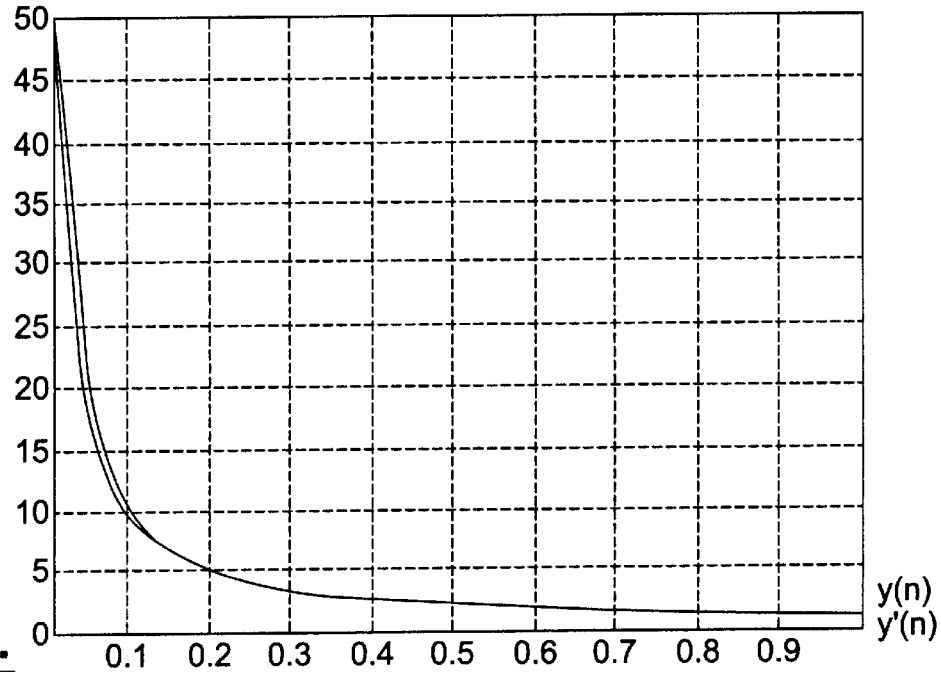
FIG. 5 is a diagram showing results of a simulated operation of the system of the invention and the deviations from exact calculation values.

The results of a simulation of the operation of the system of the invention are shown in FIG. 5, for the case in which to one input is applied a constant signal a(n)=constant and to the other input is applied a digital signal in form of a ramp (b(n)) of a relatively small gradient (slowly rising signal).

In the diagram of FIG. 5, the curve (y(n)) represents the set of the exactly calculated, values of the ratio while the y'(n) curve represents the results produced by the system of FIG. 4. As it may be observed, for signals (the signal b(n) in the simulated example) filtered through a lowpass filter with a time constant greater than or equal to 3 msec., the results produced by the system of the invention deviate negligibly from the exact values.

In practice we may observe that the more the input signals are low frequency signals (free of high frequency harmonic components) the more the system tends to produce results that deviate little from the exact values of the ratio between the two input values, thus confirming the validity of the algorithm (1).

Figure 6:
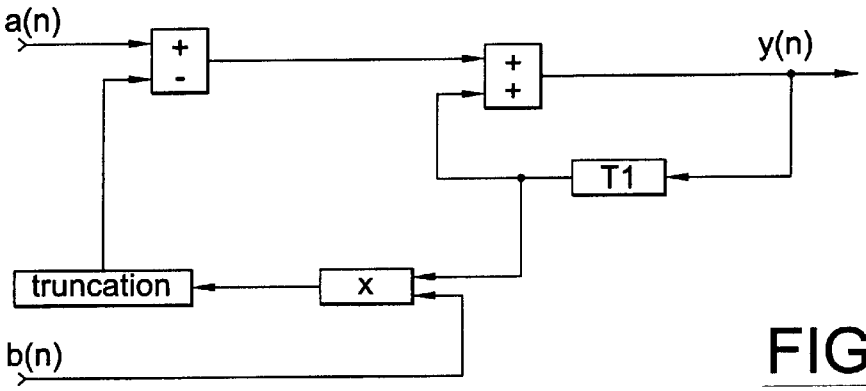
FIG. 6 is the functional diagram of a sample embodiment.

For maximum simplification of the practical realization of the system of the invention on hardware platforms suitable to handle integer numbers (bit true), it may be necessary to operate an appropriate quantization of the digital signal values thought remaining within the realm of this invention, with the aim of making g equal to 1, thus avoiding the need to execute a multiplication. Therefore, by assuming a quantization of the digital data of the two input streams, a(n) and b(n), upstream of the processing circuit of the invention, the latter may be advantageously simplified, as shown in FIG. 6.

The truncation (elimination of a certain number of least significant bits) introduced in the feedback loop has the purpose of containing the internal dynamics of the processing circuit of the invention. This avoids possible overflows since the feedback loop would otherwise tend to increase the precision indefinitely. Depending on the number of bits with which the data of the two digital input streams are codified, an appropriate truncation allows maintaining good signal-to-noise performance, in compliance with the specifications of the particular application.

Figure 7:
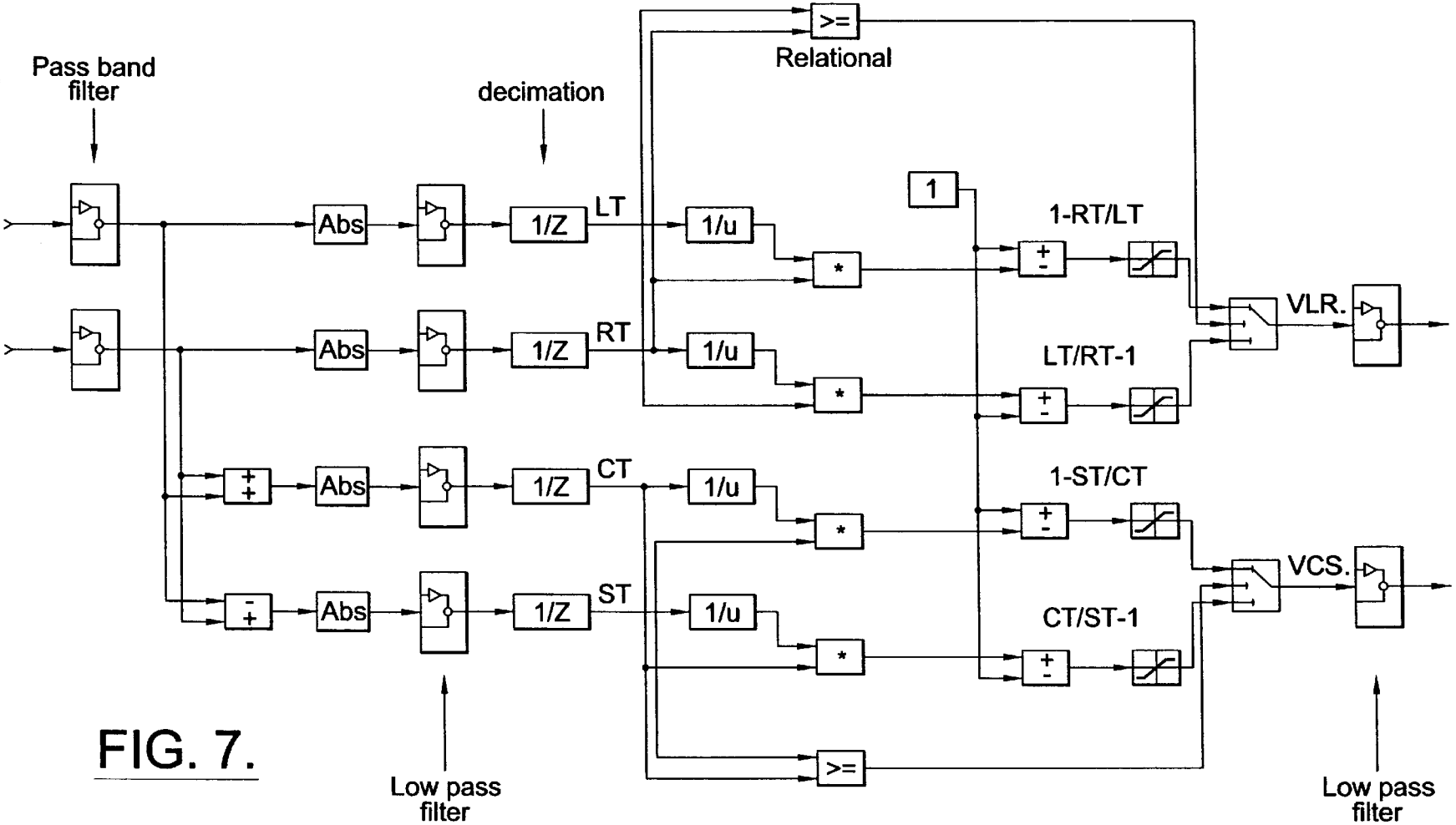
FIG. 7 is a block diagram of a preferred embodiment of the system of invention along the lines of FIG. 3.
Figure 8:
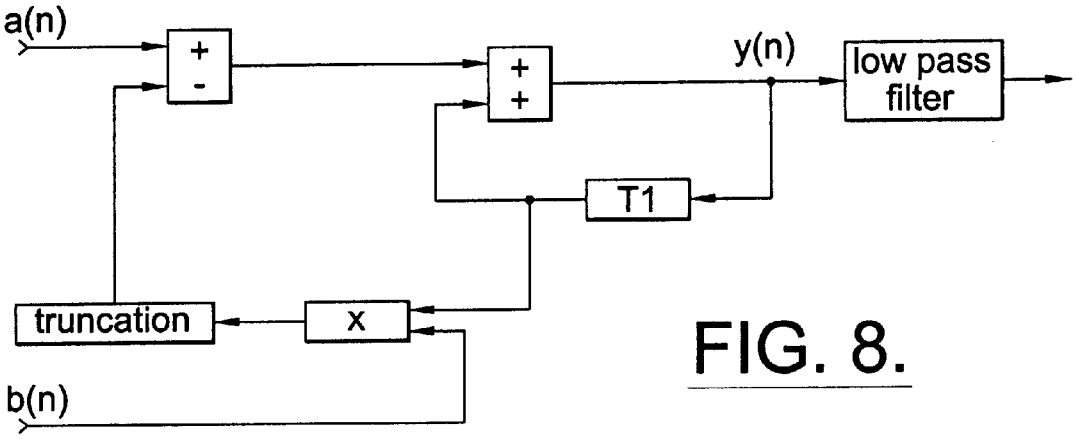
FIG. 8 is a block diagram of a preferred embodiment of the system of the invention of FIG. 6.

According to a preferred embodiment, it is envisaged the use of a further lowpass filter downstream of the circuitry for dynamic computation, according to the alternative diagrams of FIGS. 7 and 8. The optional insertion of a lowpass filter downstream of the circuitry for dynamic computation allows reconstructing the ratio between the two input signals, while attenuating the error components that the upstream block concentrates outside of the band of interest. This, as already observed, depends on the time constant of the lowpass filters that precedes in the signal stream, the circuitry of the ratio computation. Therefore, it is advantageous, though not essential, to use a similar lowpass filter, having the same time constant of the low pass filters upstream of the circuitry for dynamic computation, at the output (i.e. downstream of the computing circuitry), with the purpose, as previously mentioned, of cleaning up the output ratio from eventual computing errors.

That which is claimed is:

1. A method of dynamically computing a ratio y(n) between two digital values, respectively a(n) and b(n), representing the $n^{th}$ elements of two respective sequences of digital input data representing two quantities slowly varying in time, the method comprising the steps of:

implementing the following algorithm:

$$y(n)=y(n-1)+g*[a(n)-b(n)*\ y(n-1)]$$

wherein g represents a constant factor, and which, in a domain of the z transform, becomes:

$$Y(z)=z^{-1}*Y(z)+g[A(z)-B(z)\ \text{conv}\ Y(z)z^{-1}]$$

where conv indicates an operation of convolution, and which for input sequences corresponding to signals filtered through a lowpass filter having a predetermined time constant is simplified to:

$$Y(z)=\frac{g*A(z)}{1-z^{-1}+g*B(z)*z^{-1}}=\frac{A}{B}.$$

2. A method according to claim 1, wherein the predetermined time constant is greater than or equal to about 3 milliseconds.

3. A method according to claim 1, further comprising the steps of using the dynamically computed ratio for Dolby Pro Logic decoding.

4. A circuit for dynamically computing a ratio y(n) between two digital values, respectively a(n) and b(n), representing the $n^{th}$ elements of respective first and second sequences of digital input data representing two quantities slowly varying in time, said circuit comprising.

a differentiator having first inputs to which are fed the first sequence of digital input data a(n), second inputs, and corresponding outputs for a sequence of digital values equal to a difference between the first and second sequences of digital values;

a constant multiplier for multiplying by a constant and having inputs coupled to the outputs of said differentiator, and corresponding outputs;

an adder having first inputs coupled to the outputs of said constant multiplier, second inputs and corresponding outputs at which a digital ratio value y(n) is produced;

a first array of bistable, one clock cycle delay circuits having inputs coupled to the outputs of said adder and as many outputs coupled to the second inputs of said adder;

a second array of bistable, one clock cycle delay circuits having inputs coupled to the outputs of said adder and as many outputs; and a multiplier circuit having first inputs coupled to the outputs of said second array of bistable circuits and second inputs to which are fed the second sequence of digital input data b(n) and as many outputs coupled to the second inputs of said differentiator.

5. A circuit for dynamically computing a ratio y(n) between two digital values, respectively a(n) and b(n), representing the $n^{th}$ elements of two respective sequences of digital input (data representing two quantities slowly varying in time, the circuit comprising:

a differentiator having first inputs to which are fed the first sequence of digital input data a(n), second inputs and corresponding outputs for a sequence of digital values equal to a difference between the input digital values;

an adder having first inputs coupled to the outputs of said differentiator, second inputs and corresponding outputs at which the ratio y(n) is produced;

an array of bistable, one clock cycle delay circuits having inputs coupled to the outputs of said adder and as many outputs coupled to the second inputs of said adder;

a multiplier circuit having first inputs coupled to the outputs of said array of bistable circuits and second inputs to which is fed the other sequence of digital input data b(n) and as many outputs coupled to the second inputs of said differentiator.

6. A Dolby Pro Logic decoding system comprising:

at least one pair of multiplier circuits receiving as inputs a first and a second input sequence, respectively, representing two digitized and codified input audio signals;

an input balance circuit having outputs connected to inputs of said at least one pair of multiplier circuits for inputting respective amplitude control signals thereto;

an output balance circuit having inputs connected to respective outputs of said at least one pair of multiplier circuits;

a control circuit receiving through two inputs the output sequences of said at least one pair of multiplier circuits and generating control signals for said input balance circuit and for said output balance circuit, said control circuit comprising at least one passband filtering stage for the two input sequences, an adder stage, a differentiation stage of the two input sequences, and at least one lowpass filtering stage of four sequences so produced, said control circuit further comprising at least one dynamic computing circuit for the ratio y(n) of two digital values, respectively a(n) and b(n), representing the $n^{th}$ elements of two sequences, the value of which slowly varies in time, said at least one dynamic computing circuit comprising a differentiator having first inputs to which are fed the first sequence of digital input data a(n), second inputs, and corresponding outputs for a sequence of digital values equal to a difference between the first and second sequences of digital values;

a constant multiplier for multiplying by a constant and having inputs coupled to the outputs of said differentiator, and corresponding outputs;

an adder having first inputs coupled to the outputs of said constant multiplier, second inputs and corresponding outputs at which a digital ratio value y(n) is produced;

a first array of bistable, one clock cycle delay circuits having inputs coupled to the outputs of said adder and as many outputs coupled to the second inputs of said adder;

a second array of bistable, one clock cycle delay circuits having inputs coupled to the outputs of said adder and as many outputs; and a multiplier circuit having first inputs coupled to the outputs of said second array of bistable circuits and second inputs to which are fed the second sequence of digital input data b(n) and as many outputs coupled to the second inputs of said differentiator.

7. A Dolby Pro Logic decoding system comprising:

at least one pair of multiplier circuits receiving as inputs a first and a second input sequence, respectively, representing two digitized and codified input audio signals;

an input balance circuit having outputs connected to inputs of said at least one pair of multiplier circuits for inputting respective amplitude control signals thereto;

an output balance circuit having inputs connected to respective outputs of said at least one pair of multiplier circuits;

a control circuit receiving through two inputs the output sequences of said at least one pair of multiplier circuits and generating control signals for said input balance circuit and for said output balance circuit, said control circuit comprising at least one passband filtering stage for the two input sequences, an adder stage, a differentiation stage of the two input sequences, and at least one lowpass filtering stage of four sequences so produced, said control circuit further comprising at least one dynamic computing circuit for the ratio y(n) of two digital values, respectively a(n) and b(n), representing the $n^{th}$ elements of two sequences, the value of which slowly varies in time, said at least one dynamic computing circuit comprising a differentiator having first inputs to which are fed the first sequence of digital input data a(n), second inputs and corresponding outputs for a sequence of digital values equal to a difference between the input digital values;

an adder having first inputs coupled to the outputs of said differentiator, second inputs and corresponding outputs at which the ratio y(n) is produced;

an array of bistable, one clock cycle delay circuits having inputs coupled to the outputs of said adder and as many outputs coupled to the second inputs of said adder;

a multiplier circuit having first inputs coupled to the outputs of said array of bistable circuits and second inputs to which is fed the other sequence of digital input data b(n) and as many outputs coupled to the second inputs of said differentiator.

* * * * *

UNITED STATES PATENT AND TRADEMARK OFFICE

CERTIFICATE OF CORRECTION

PATENT NO. : 6,094,488
DATED : July 25, 2000
INVENTOR(S) : Bianchessi et al.

It is certified that error appears in the above-identified patent and that said Letters Patent is hereby corrected as shown below:

Column 3,
Line 40, delete "Y(z) = z-1 * Y(z) + g * 8A(z)- B(z)conv Y(z) * z-1]" insert
-- Y(z) = z-1 * Y(z) + g * [A(z)- B(z)conv Y(z) * z-1] --

Column 4,
Line 34, delete "FIG. 5" insert -- FIG. 4 --

Signed and Sealed this

Twenty-sixth Day of August, 2003

JAMES E. ROGAN
*Director of the United States Patent and Trademark Office*